United States Patent [19]

Greer

[11] 3,942,289

[45] Mar. 9, 1976

[54] FLUSH TANK VALVE SEAT REFACER

[76] Inventor: Lucian F Greer, P.O. Box 5461, Midland, Tex. 79701

[22] Filed: Dec. 23, 1974

[21] Appl. No.: 535,977

[52] U.S. Cl. ..... 51/241 VS; 90/12.5
[51] Int. Cl.[2] ..... B24B 15/02
[58] Field of Search..... 51/241 R, 241 VS, 241 G, 51/241 S, 170 T; 90/12.5

[56] References Cited

UNITED STATES PATENTS

| | | | |
|---|---|---|---|
| 2,203,143 | 6/1940 | Haas | 51/241 VS |
| 2,292,383 | 8/1942 | Liebmann | 51/241 VS |
| 2,394,882 | 2/1946 | Weynand | 51/241 VS |

*Primary Examiner*—Al Lawrence Smith
*Assistant Examiner*—Nicholas P. Godici
*Attorney, Agent, or Firm*—Marcus L. Bates

[57] ABSTRACT

A refacer tool for grinding a horizontally disposed face onto a flush tank valve assembly. A stationary guide means is rotatably captured respective to a shaft means, with a grinding rock being attached to the shaft and superimposed in axially aligned relationship respective to the guide means, with provisions on the upper extremity of the shaft for engagement with a crank means. The guide means engages the bore of the valve assembly, so that the grinding rock can be brought into engagement with the upper extremity of the valve seat, whereupon rotatable motion of the rock imparts the upper extremity of the seat with a smooth annular surface for sealingly engaging a flapper valve element.

10 Claims, 10 Drawing Figures

FLUSH TANK VALVE SEAT REFACER

BACKGROUND OF THE INVENTION

The flush tank of a commode has a valve seat assembly which cooperates with a valve element so that when the toilet is flushed, the valve element is lifted from the seat, thereby emptying the contents of the tank into the commode as is known to those skilled in the art. Various flush tank valve assemblies are available on the market and over the past several years they have become standardized so that one valve assembly can be readily substituted for the other.

For example, the Douglas flush valve assembly can be substituted for most any valve assembly found on various different bathroom commodes.

The valve elements of the prior art take on several different forms, including a conical valve element which sealingly engages a complimentary shaped valve seat. In recent years a flapper-type valve element, such as the "Korky" flapper valve element has become popular. The flapper type valve element sealingly engages the upper horizontally disposed rim of the valve seat; and for this reason, when the Korky flapper valve element is substituted for the old conical-type valve element, it is essential that the upper lip of the valve seat be made smooth by somehow removing the irregular surface formed during the casting of the valve assembly.

In recent years, many manufacturers have commenced dressing the circumferentially extending uppermost lip portion of the valve seat in expectation of alternate usage of either of the above described valve elements. However, as time progresses, corrosion and deposition of salts render the upper surface of the lip unsuitable for sealingly engaging the flapper-type valve element; and accordingly, from time to time, it is necessary to reface this horizontally disposed lip of the valve seat.

Therefore, it is desirable to have made available a refacing tool which can be employed to rapidly and efficiently form a smooth horizontally disposed face on any existing valve seat of the various prior art valve assemblies associated with a flush tank device.

SUMMARY OF THE INVENTION

This invention relates to a grinding apparatus and specifically to a flush tank valve seat refacer having a stationary guide member for placement within the valve seat assembly of a flush tank. A vertically disposed shaft is rotatably received within a central aperature formed through the guide member, and includes spaced abutment means for rotatably capturing the guide means therebetween. A grinding rock is provided with a horizontally disposed flat face, which is positioned normally respective to the shaft and parallel respective to the seat to be formed. The rock is ridgidly affixed to the shaft, and the shaft is provided with means by which it can be rotated respective to the guide means.

The guide means is inserted within the central axial bore of the valve seat assembly, thus positioning a grinding face of the rock against the valve seat lip which is to be dressed, and the shaft is manipulated with a suitable tool so that the upper face or lip of the valve seat can be smoothed.

Accordingly, a primary object of this invention is the provision of improvements in tools for refacing a valve seat of a flush tank valve assembly.

Another object of the invention is to provide a refacting tool having a guide means and a grinding means arranged respective to one another so that the guide means can be inserted into the valve assembly and the grinding means brought into engagement with the seat which is to be refaced.

A further object of this invention is to disclose and provide a guide means which is captured within a valve seat assembly of a flush tank, so that a grinding rock rotatably supported respective to the guide means can be brought into engagement with the valve seat, thereby refacing the seat.

A still further object of this invention is to provide a valve seat refacer tool having a grinding surface thereon which conforms to the upper extremity of a valve seat, with the grinding surface being rotatably attached to a guide means so that the upper extremity of a flush tank valve seat can be ground or refaced.

Another and still further object of this invention is to provide a flush tank valve seat refacer which can be manufactured economically, is simple in construction, has a minimal number of parts, and is adapted to provide service over a long period of time.

These and other objects and advantages of the invention will become readily apparent to those skilled in the art upon reading the following detailed description and claims and by referring to the accompanying drawings.

The above objects are attained in accordance with the present invention by the provision of an apparatus fabricated in a manner substantially as described in the above abstract and summary.

DETAILED DESCRIPTION OF THE PREFERRED EMBODIMENTS

Figure 1:
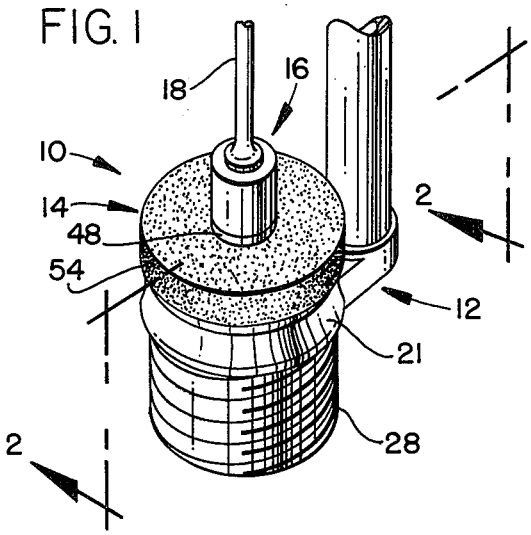
FIG. 1 is a perspective view which discloses the present invention operatively associated with a flush tank valve seat assembly, with some parts being broken away therefrom so as to conserve drawing space.

FIG. 1 discloses a flush tank valve seat refacer tool 10 made in accordance with the present invention. The tool is disclosed in operative relationship respective to a flush tank valve seat assembly 12. The tool has an upper rotatable part 14 which is preferably turned by a socket set 16, with the socket being engaged by a crank 18 or the like.

Throughout the remaining figures of the drawings, wherever it is logical or practical to do so, like or similar numerals will refer to like or similar elements.

Figure 2:
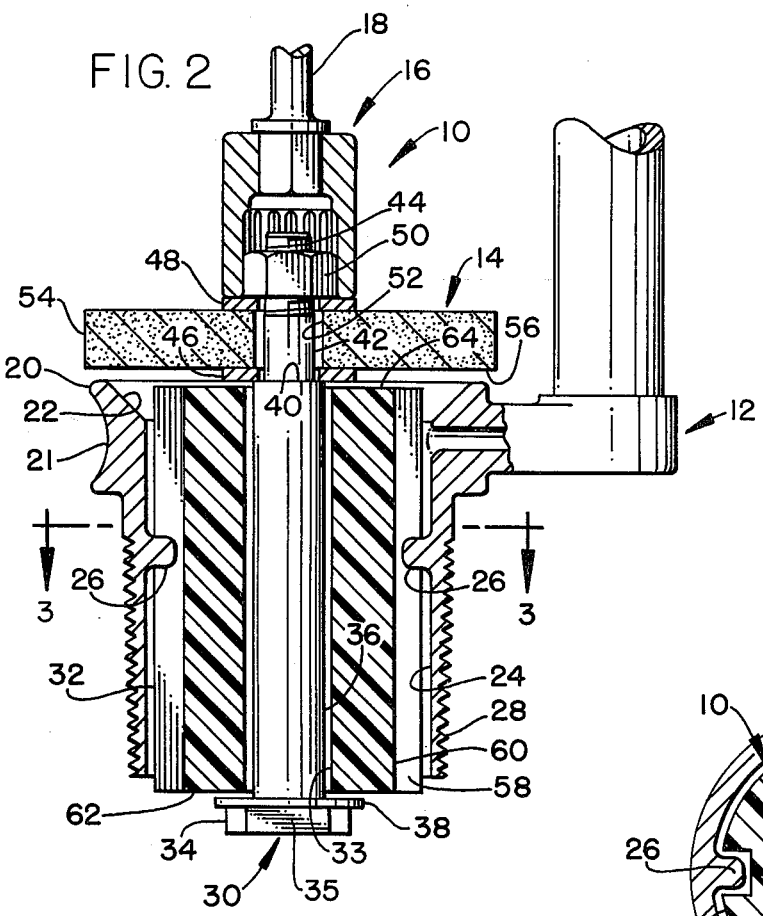
FIG. 2 is an enlarged, longitudinal, cross-sectional view, taken along line 2—2 of FIG. 1.

In FIG. 2, in conjunction with some of the remaining figures, the flush valve assembly is seen to be provided with an upper marginal end portion, the upper extremity of which is formed into a circumferentially extending horizontally disposed lip portion 20, which defines the uppermost extremity of a conical valve seat 22, all of which is formed within a valve body 21.

The valve seat assembly, or valve body, is provided with a central bore 24 and usually has at least one inwardly directed projection 26 cast therein for indexing purposes during the manufacture thereof. The lower outer marginal end portion of the valve assembly is threaded in the usual manner at 28 for attachment to a water closet of a flush type commode.

The tool of the present invention comprises a central mandrel in the form of a bolt or a shaft 30 which rotatably receives a vertically disposed cylindrical stationary guide means 32. An axial bore, or passageway, 33 is formed through the guide means. The mandrel has a lower upset end portion formed into an abutment 34, which is provided with opposed flats 35 for engagement with a wrench. The mandrel has a longitudinally extending marginal portion 36 received within bore 33, with a washer 38 being disposed between the lower abutment means and the guide means.

Portion 36 of the mandrel terminates at an inwardly directed shoulder 40 which is formed by reducing the diameter of the mandrel at 42, with the upper marginal end of the reduced diameter portion of the mandrel being threaded at 44.

Washer 46 abutingly engages shoulder 40 and is spaced from washer 48 so that a nut 50 can threadedly engage the threaded area 44, thereby compressing washers 48 and 46 towards one another and into engagement with shoulder 40. Accordingly, it is apparent that washers 38 and 46 constitute spaced apart abutment means which rotatably capture the guide means in low friction relationship therebetween.

The grinding wheel 14 is provided with a central aperture 52 of a diameter suitable for receiving reduced diameter portion 42 of the mandrel therethrough. The outer diameter 54 of the grinding wheel defines the area of a horizontally disposed lower face 56. The lower face 56 is of a diameter suitable for low friction engagement with the upwardly directed lip 20. The outer peripheral marginal edge surface 54 of the grinding wheel is spaced from the illustrated overflow pipe a sufficient amount to avoid inadvertent contact therewith.

Figure 3:
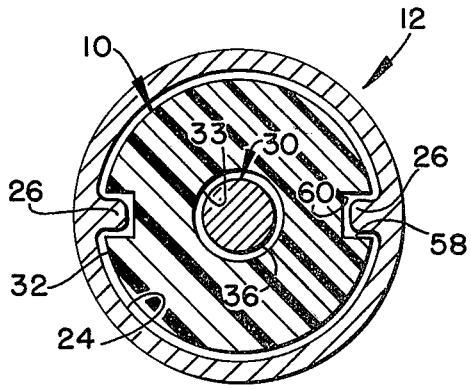
FIG. 3 is a cross-sectional view taken along line 3—3 of FIG. 2.
Figure 4:
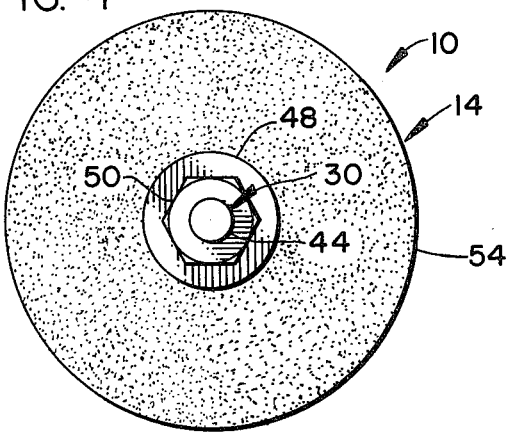
FIG. 4 is a top view of part of the apparatus disclosed in the foregoing figures, looking in the direction indicated by the numerals 4—4 in FIG. 7.
Figure 5:
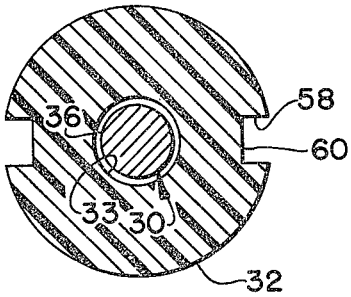
FIG. 5 is a cross-sectional view taken along line 5—5 of FIG. 7.
Figure 6:
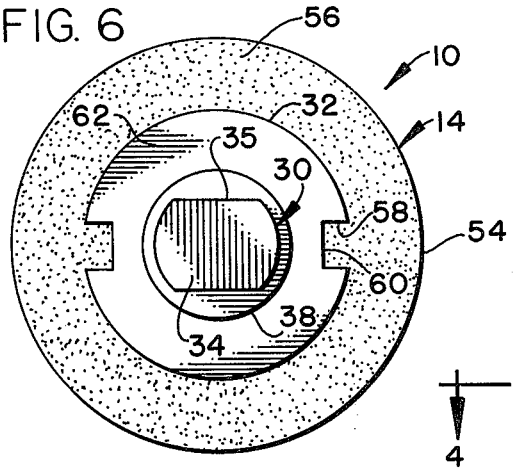
FIG. 6 is a bottom view looking in the direction indicated by the arrows at numeral 6—6 in FIG. 7.
Figure 7:
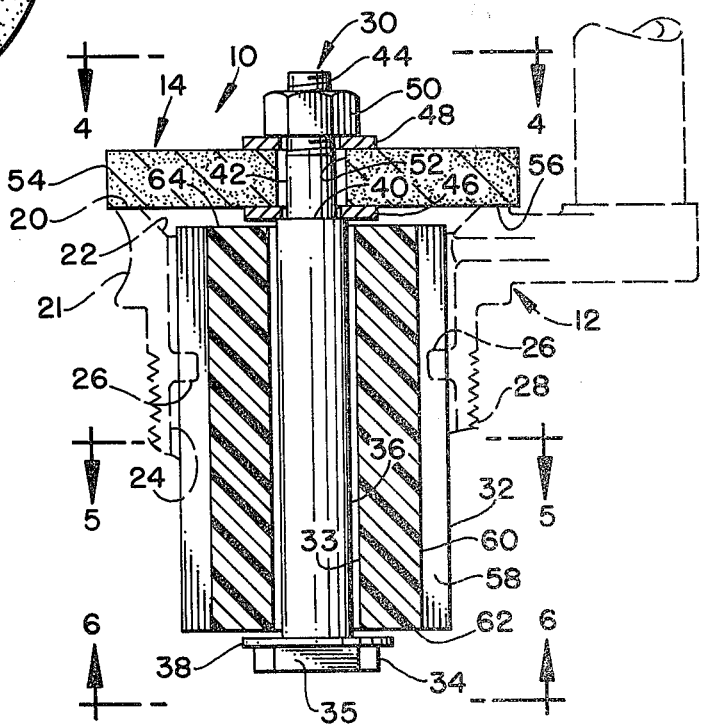
FIG. 7 is a cross-sectional view such as seen in FIG. 2, but with the apparatus of the invention being isolated from the valve assembly, and with the valve assembly being indicated by dot-dash lines.

Vertically disposed, longitudinally arranged, diametrically opposed grooves 58 are formed within the stationary guide means and are of a depth and width to enable the grooves to slidably receive the protrusions 26 therewithin, as best seen illustrated in FIGS. 2 and 3. The grooves preferably extend from the lowermost face 62 to the uppermost face 64 of the guide means.

Figure 8:
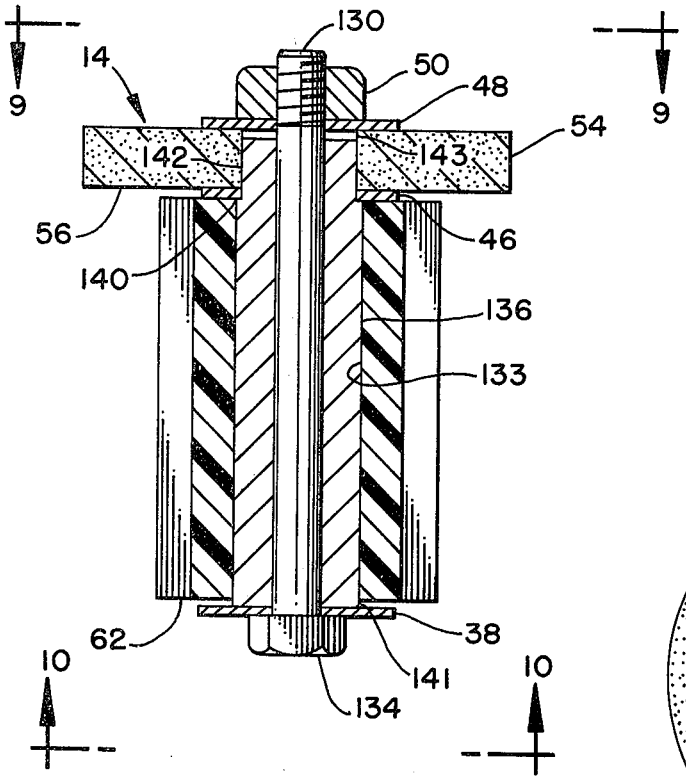
FIG. 8 is a longitudinal, cross-sectional view of a modification of the apparatus disclosed in the foregoing figures.
Figure 9:
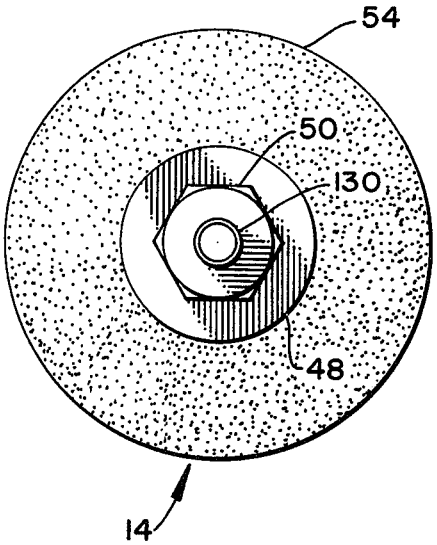
FIG. 9 is a top plan view of the apparatus looking in the direction indicated by the arrows at numerals 9—9 in FIG. 8; and, FIG. 10 is a bottom view looking in the directions indicated by the arrows at numeral 10—10 of FIG. 8.
Figure 10:
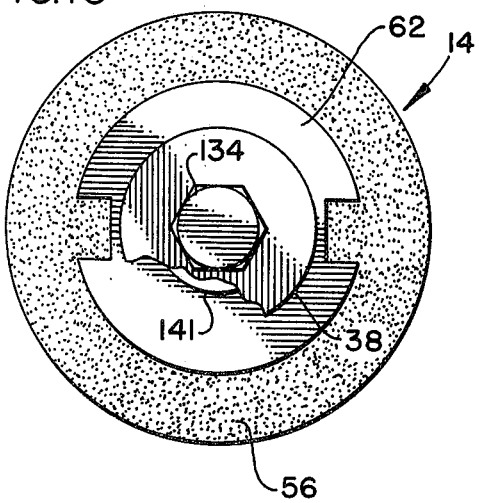

Looking now to the details of the embodiment disclosed in FIGS. 8–10, the mandrel 136 is seen to be comprised of an apertured cylindrical body member having a shoulder 140 formed thereon so that a common bolt having a hex-head 134 can be placed under tension by means of a common nut 50, thereby compressing washers 46 and 48 together with the grind wheel being interposed in sandwiched relationship therebetween, thereby ridgidly affixing the grinding wheel to the mandrel while the bolt is placed in tension.

This arrangement of elements places the bolt in tension, with the abutment means 38 and 46 being forced toward one another; thereby loosely and rotatably capturing the guide means therebetween. The guide means forms a slidable interface 133 respective to the mandrel, so that the mandrel can be rotated in low friction relationship respective thereto. The upper reduced diameter marginal end portion 142 of the mandrel is spaced at 143 from the washer 48 so that the grinding wheel is properly torqued in compressed and sandwiched relationship between the two spaced washers.

OPERATION

The apparatus disclosed in the embodiment of FIGS. 1–7 is assembled by placing washer 38 onto the mandrel or shaft head 30, sliding the loosely fitting guide means 32 onto the mandrel, thereafter sliding washer 46 into abutting engagement with shoulder 40. Next the centrally apertured grinding wheel is placed onto the reduced diameter portion of the mandrel and washer 48 is placed against the grinding wheel. Thereafter, nut 50 is torqued to a value which ridgidly affixes the grinding wheel to the upper marginal end of the mandrel and rotatably captures the guide means upon the lower marginal end of the mandrel.

After removing the existing flush valve element from the flush valve seat assembly of the water closet, the tool is placed within the central bore of the valve seat assembly in the illustrated manner of FIG. 2, so that the lower horizontally disposed face of the grind wheel comes to rest on the upturned lip of the entrance to the valve seat, while the opposed grooves of the guide member each engage the inwardly directed indexing protrusions formed within the valve seat bore.

The mandrel is rotated with a suitable crank means so that the lower face of the grinding wheel "dresses" the upper surface of the lip by grinding material therefrom until a suitable flat surface is formed about the entire circumferentially extending horizontal outwardly directed face of the lip.

The tool is removed from the valve assembly and the flapper valve installed in operative relationship respective to the lip 20. The water closet is now in proper condition for providing service until the upper lip deteriorates with time and usage, whereupon the above procedure can be repeated as may be required.

Where deemed desirable, dual refacing tools can be employed with one tool having a coarse rock, and the other tool having a polishing rock so that material can first be rapidly removed from the face with the coarse rock and thereafter polished with a smoother rock to provide a better seal between the flapper valve and the lip. Moreover, a rock having a relatively coarse and fine face, respectively, can be provided at opposed sides of the rock.

The tool disclosed in the embodiment of FIGS. 8–10 is assembled by placing the washer 38 upon the illustrated bolt; placing the bolt through the axial bore of the mandrel; placing the guide means upon the mandrel and into abutting engagement with washer 38; placing washer 46 upon shoulder 140; telescoping the grinding wheel and then the washer 48 into the illustrated position of FIG. 8; and thereafter torquing nut 50 onto the threaded end of the bolt with sufficient force to ridgidly affix the wheel to the mandrel and at the same time capture the guide member between the abutment means 38 and 46. It will be noted that a space 141 is left between the abutment means while interface 133 is of a close tolerance fit respective to the coacting members thereof.

The tool of the embodiment of FIGS. 8–10 is used in the same above described manner of the first embodiment of the invention.

Those skilled in the art, having digested the above disclosure, will appreciate that the tool of the present invention can be used without removing the valve seat assembly from the water closet. The tool is best used by flushing the toilet, removing the existing valve element from the valve seat assembly, and thereafter sliding the loosely fitting guide means into the illustrated position of FIG. 2. The guide means of the present invention preferably is made of a size and configuration to be loosely captured in a slidable manner within the central bore of the valve seat assembly so that the grinding member thereof is inherently self aligned respective of the lip to be resurfaced.

The tool is manipulated in the before described manner, thereby dressing the lip into a smooth surface, whereupon the tool is removed and a flapper type valve element is next properly positioned on the valve seat assembly. This sequence of events renders the commode operational for an extended period of time whereupon the flush valve assembly can again be overhauled in the above described manner, as may be desired.

I claim:

1. A flush tank valve seat refacer tool for refacing a valve seat of a flush tank valve assembly comprising:

a stationary guide member in the form of an elongated cylinder having an axial bore formed therethrough, and a radial groove formed in an outer marginal wall portion thereof for removably engaging the interior of a flush valve assembly;

a mandrel having a marginal length thereof received within said axial bore; said mandrel having spaced apart abutment means formed thereon which rotatably captures said guide means therebetween;

a grinding member having a central aperture and a horizontal disposed flat face which is normally disposed with respect to said mandrel; a marginal length of said mandrel being in the form of a bolt, said bolt portion of said mandrel being received through said cental aperture of said grinding member; fastener means by which the last said member is attached to the mandrel in overlying relationship respective to said guide means; said mandrel having means thereon for rotating said grinding members respective to said guide means;

said groove being diposed parallel to said mandrel and arranged to engage an indexing protrusion which may be formed within an axial bore of a valve assembly, said grinding member having a diameter greater than the outermost diameter of said guide member;

so that, said guide means can be placed within the axial central passageway of a valve seat assembly associated with a flush tank assembly, said mandrel can be rotatably engaged with a crank means, and said flat face of said grinding member can be brought into engagement with the valve seat, thereby grinding a seating face onto an upwardly disposed part of the valve seat.

2. The refacer tool of claim 1 wherein one said abutment means includes a shoulder formed on said mandrel in spaced relationship to another of said abutment means, a load bearing washer telescopingly received about an upper marginal portion of said mandrel and brought into engagement with said shoulder, a second washer axially aligned and superimposed in spaced relationship to said abutment means, said grinding member being sandwiched between said washers by said fastener means which places said bolt in tension and compresses the last said member therebetween.

3. The refacer tool of claim 1 wherein said guide means has at least two opposed, longitudinally disposed, vertically aligned grooves formed in a marginal outer surface thereof for engagement with an inwardly directed protrusion formed on the bore of the valve seat; and, said mandrel has a shoulder formed thereon in spaced relationship to the lowermost of said abutment means, a load bearing washer telescopingly received about an upper marginal portion of said mandrel and brought into engagement with said shoulder, a second washer axially aligned and superimposed in spaced relationship to an uppermost of said abutment means, said grinding member being sandwiched between each of said washers by a fastener means which compresses the grinding member therebetween.

4. A flush tank valve seat refacer tool, comprising, a stationary guide member in the form of an elongated cylinder having an axial bore formed therethrough, and having at least one radial groove formed within an outer marginal circumferentially extending wall portion thereof for engagement with the interior of a flush valve assembly;

a mandrel having a marginal length thereof received within said axial bore, said mandrel having means forming spaced apart abutments thereon which rotatably capture said guide means therebetween;

a grinding member having a central aperture and a horizontal disposed flat face which is normally disposed with respect to said mandrel; a marginal length of said mandrel being received within said central aperture of said grinding member, fastener means by which the last said member is attached to the mandrel in overlying relationship respective to said guide means, said mandrel including means for rotating said grinding member, respective to the guide member;

said groove being disposed parallel to said mandrel for engaging any indexing protrusion which may be formed within the axial bore of a valve seat assembly, said grinding member having a diameter greater than the outermost diameter of said guide member so that a marginal outer circumferentially extending surface of said grinding member can abrasively engage an upper extremity of a lip which may be formed on the valve seat assembly, thereby forming a smooth circumferential extending surface thereon;

a marginal end portion of said mandrel being reduced in diameter to form a shoulder and a bolt means, said fastener means being affixed to said bolt means; a load distributing washer received about said bolt means and placed in abutting relationship against said shoulder;

said grinding member being interposed between said fastener means and said washer, thereby placing the bolt in sufficient tension to rigidly affix the grinding member to the mandrel;

so that said guide means can be placed within the axial central passageway of a valve seat assembly associated with a flush tank valve assembly, said mandrel can be rotatably engaged with a crank means, and said lower face of said grinding member can grind a new seating face onto the lip of the valve seat in the before described manner.

5. The refacer tool of claim 4 wherein there is included two said grooves spaced 180° apart from one another, said means for rotating said grinding member includes said fastener means which can be releasably engaged by a crank means and rotational motion imparted into said mandrel.

6. A flush tank valve seat refacer tool, comprising; a stationary guide member having means thereon for engagement with the interior of a flush valve assembly;

a central aperture formed through said guide member, a mandrel having a marginal length thereof received within said central aperture, said mandrel having spaced apart abutment means thereon which rotatably capture said guide means therebetween;

said mandrel includes a bolt means received therethrough; one end of said bolt means forms one said abutment means, another end of said bolt means forms a fastener means;

a grinding member having a central aperture and a horizontal disposed flat face which is normally disposed with respect to said mandrel; a marginal length of said mandrel being received within said central aperture of said grinding member, a load distributing washer by which said fastener means attaches the last said member to the mandrel in overlying relationship respective to said guide means, and means by which said grinding member can be rotated respective to the guide means;

so that said guide means can be placed within the axial central passageway of a valve seat assembly associated with a flush tank valve assembly, said mandrel can be rotatably engaged with a crank means, and said flat face of said grinding member can be brought into engagement with an upturned lip of said valve seat, thereby grinding a seating face onto the lip of the valve seat.

7. The tool of claim 6 wherein said guide means comprises an elongated body having a longitudinally disposed, vertically aligned groove formed in a marginal outer surface area thereof for engagement with an inwardly directed protrusion formed within the central bore of the valve seat assembly.

8. The tool of claim 6 wherein one said abutment means includes a shoulder formed on said mandrel in spaced relationship to another of said abutment means, a load bearing washer telescopingly received about an upper marginal portion of said mandrel and brought into engagement with said shoulder, a second washer axially aligned and superimposed in spaced relationship to said abutment means, said grinding member being sandwiched between said washers by said fastener means which places said bolt in tension and compresses the last said member therebetween.

9. The refacer tool of claim 6 wherein there is included two said grooves spaced 180° apart from one another, said means for rotating said grinding member includes said fastener means which can be releasably engaged by a crank means and rotational motion imparted into said mandrel.

10. The refacer tool of claim 6 wherein said guide means is an elongated cylinder having an axial bore formed therein, radially spaced apart grooves formed within an outer marginal wall portion thereof;

said grooves being diametrically disposed in parallel relationship to one another and arranged to engage an indexing protrusion which may be formed within said axial bore of the valve seat assembly, said grinding member having a diameter slightly greater than the outermost diameter of said lip of said valve seat so that a marginal outer circumferentially extending portion of said grinding member abrasively engages the upper extremity of said valve seat assembly, thereby forming a smooth circumferentially extending annular surface thereon.

* * * * *